US005386991A

United States Patent [19]

Rochette

[11] Patent Number: 5,386,991

[45] Date of Patent: Feb. 7, 1995

[54] GAMES RACKETS

[76] Inventor: Robert C. Rochette, 6550 Richer Drive, Gloucester, Ontario, Canada, K1C 3G4

[21] Appl. No.: 220,944

[22] Filed: Mar. 31, 1994

Related U.S. Application Data

[63] Continuation of Ser. No. 954,367, Sep. 30, 1992, abandoned.

[51] Int. Cl.[6] ..... A63B 59/00

[52] U.S. Cl. ..... 273/67 R; 273/73 C; 273/73 L

[58] Field of Search ..... 273/73, 67

[56] References Cited

U.S. PATENT DOCUMENTS

| | | | |
|---|---|---|---|
| 3,833,219 | 9/1974 | Dean | 273/73 J |
| 4,102,533 | 7/1978 | Ida | 273/73 E |
| 4,205,844 | 6/1980 | Gombas | 273/73 G |

OTHER PUBLICATIONS

"The Sporting Goods Dealer" (advertisement) May 1981.

*Primary Examiner*—Mark S. Graham
*Attorney, Agent, or Firm*—Dykema Gossett

[57] ABSTRACT

A games racket or the like of the type having a strung head frame connected to a shaft, grip or handle wherein the shaft has a longitudinal slit accessible for feeding a string or band (hereinafter string) loop for stringing across t he head frame to provide striking surfaces of the head.

7 Claims, 2 Drawing Sheets

GAMES RACKETS

This is a continuation of copending application(s) Ser. No. 07/954,367 filed on Sep. 30, 1992 now abandoned.

BACKGROUND OF THE INVENTION

1. Field of the Invention

The present invent ion relates to games rackets in general, such as rackets for games played with a shuttlecock or bird or a ball. More particularly, the rackets are configured to permit stringing with strings or bands by the user (player), so that substitution of ruptured strings or bands is easily accomplished. More particularly still, the strings or bands of a racket are installed around the outside frame of the striking surface and, where necessary, are inserted through a longitudinal slit in the racket shaft or handle. In the preferred embodiment, the racket is strung by two sets of perpendicular rubber bands located across the striking surface by means of commensurate indentations, recesses or notches around the outer periphery of the head frame.

1. Prior Art of the Invention

It has been recognized at least as early as 1935 that it is desirable to substitute new strings easily fox broken ones without taking the racket to an expert. An early U.S. Pat. No. 2,080,642 granted May 18, 1937 to Timpe provided wedge means of rubber for holding the ends or other parts of strings in holes in the frame of the racket to achieve such purpose. The Timpe patent also teaches the use of strings of rubber or resilient material of "flat construction." The end of the flat string is partly encircled about the wedge so that the wedge forces the string against the wall of the hole and thus securely holds it in place . Advantages of stringing with rubber strings are recited in the first paragraph of the Timpe patent.

U.S. Pat. No. 4,220,335 granted Sep. 2, 1980 to Nobbs appears to disc lose a racket with a longitudinal split-handle design without, however, the split in the handle being of any use to string the racket.

U.S. Pat. No. 4,844,478 granted Jul. 4, 1989 to Kessler discloses paddles or rackets having variously shaped frames strung with suitable elastic strings stretched in opposite directions across the frame.

In U.S. Pat. 3,341,201 granted Sep. 12, 1967 to Ryan a head mounted rebounding device is disclosed, wherein elongate endless flexible members extend about and between frame side members at locations of indentations thereby defining a pair of substantially planar playing (striking) surfaces of grid-like construction.

SUMMARY OF THE INVENTION

The present invention provides games rackets which are easily strung with strings or bands, so that a broken string or band is easily replaced by the user/player.

Accordingly, the present, invention provides a games racket or the like of the type having a strung head frame connected to a shaft grip or handle (hereinafter shaft), wherein the shaft has a longitudinal slit accessible for feeding a string or band (hereinafter string) loop for stringing across the head frame to provide striking surfaces of said head.

In a preferred aspect, the head comprises a many sided frame with the shaft connected thereto and adjacent at least one side of the frame, wherein the longitudinal slit in the shaft communicates with a slit transversal thereto between the shaft and the head in order to permit placement of strings on either side of the longitudinal slit.

In a further preferred aspect, the frame of the head has indentations, recesses or notches for receiving and retaining strung strings.

In the preferred embodiment, the racket comprises a single molded or cast frame of a four-sided head and a shaft adjacent one side of the four-sided head, the longitudinal and transversal slits forming a T.

Preferably the shaft is formed and adapted to receive a sleeve for comfort and ease of holding by a user/-player.

Also preferred is that the notches are adapted to receive flat band loops of rubber or the like.

BRIEF DESCRIPTION OF THE DRAWINGS

A preferred embodiment of the present invention will now be described in detail in conjunction with the attached drawing figures, in which.

DETAILED DESCRIPTION OF THE PREFERRED EMBODIMENT

Figure 1:
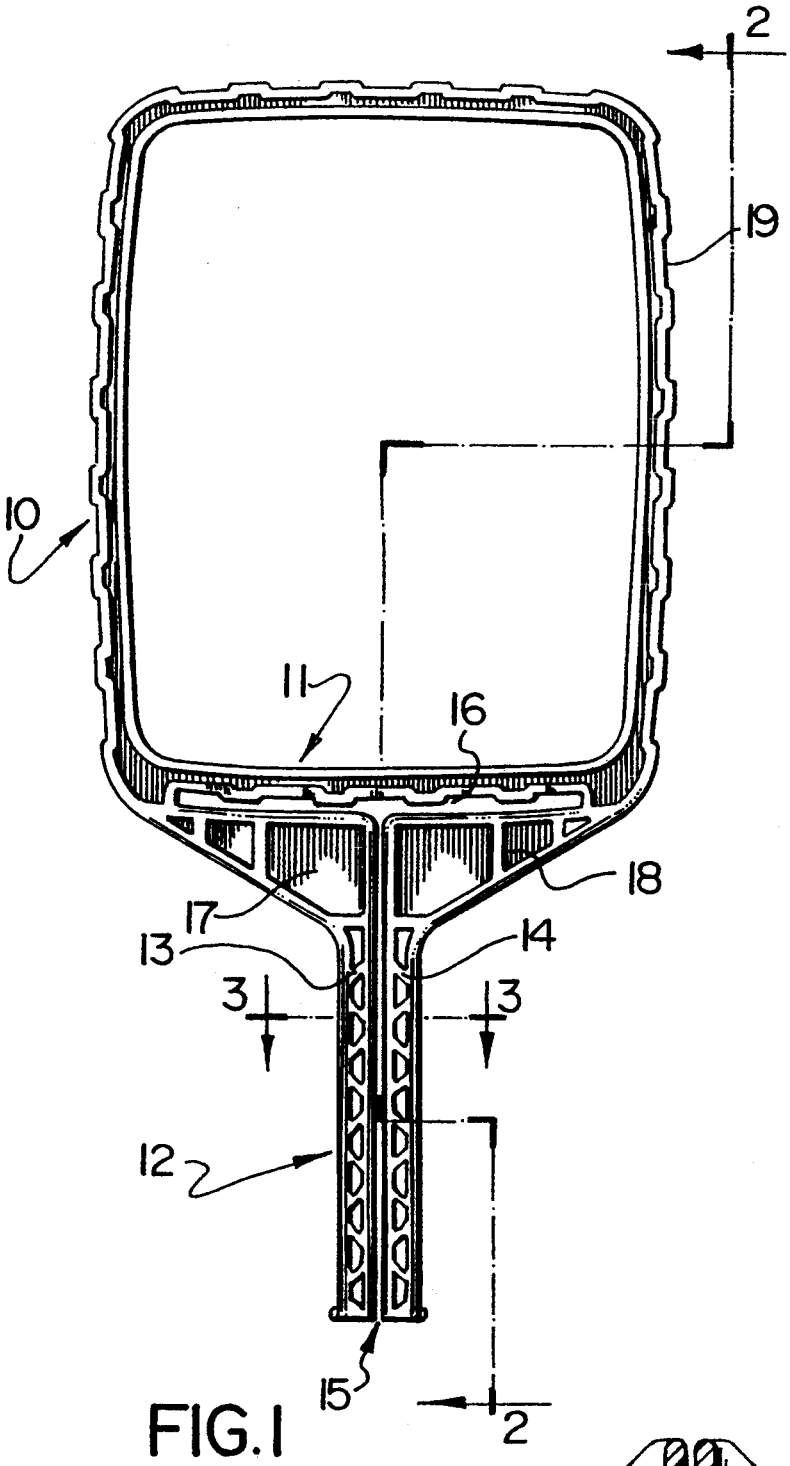
FIG. 1 is a front elevation of an unstrung racket according to the prevent invention.
Figure 2:
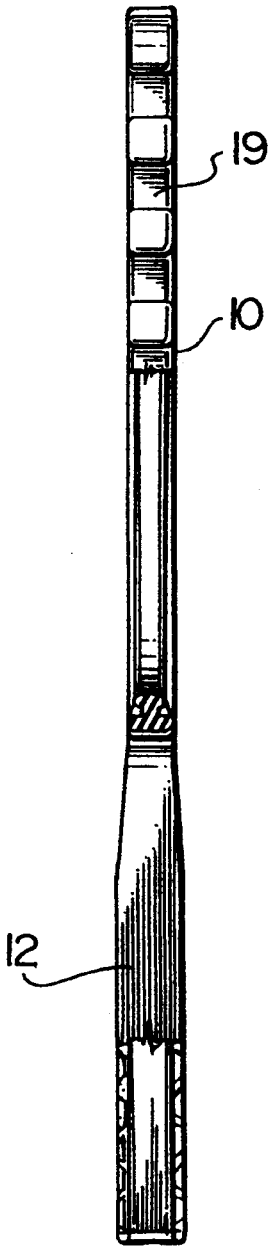
FIG. 2 is a side elevation with partial cross-section along the line 2—2 in FIG. 1.
Figure 3:
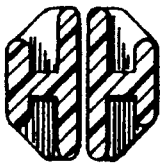
FIG. 3 is a cross-section through the shaft along the line 3—3 in FIG. 1.

Referring now to FIGS. 1 , 2 and 3 of the drawings, a racket frame (FIG. 1) according to the present invention comprises a generally rectangular head frame 10 tapering at one side 11 thereof into a central shaft 12. The shaft 12 comprises two separate longitudinal halves 13 and 14 separated by a longitudinal slit 15 forming the vertical bar of a T, the transversal bar of which is a slit 16 running parallel to the side 11. The halves 13 and 14 of the shaft 12 are integrally connected to the long sides of the head frame 10 via triangular regions 17 and 18. The entire racket frame structure has an H- or I-beam cross-section for improved rigidity and is preferably made by molding or casting from nylon with glass fill (say, 40%) or cellustrand, but could also be made from aluminum, metal alloys, graphite fibre, or even wood.

As may be seen from FIG. 2 the shaft 12 is thicker than the head frame 10 and is adapted to have a rubber sleeve or the like around it, once the racket has been strung, for comfort and ease of holding by a user/-player.

As may also be seen from FIGS. 1 and 2, the head frame 10 has indentations or recess such as recess 19 on the outside. The narrow sides of the head frame each have five recesses, while the longer sides have seven recesses each. The recesses serve to receive and retain rubber bands (that is twelve in total) strung across the head frame 10; five strung longitudinally, and seven strung transversally. The vertical slit 15 is, therefore, necessary in order to enable installation of the five longitudinal strings; or to enable replacement of a broken string by the user/player, who simply removes the sleeve and inserts the replacement string through the slits 15 and 16.

FIG. 3 shows a transversal cross-section of the shaft 12 and the H-beam construction.

Figure 4A:
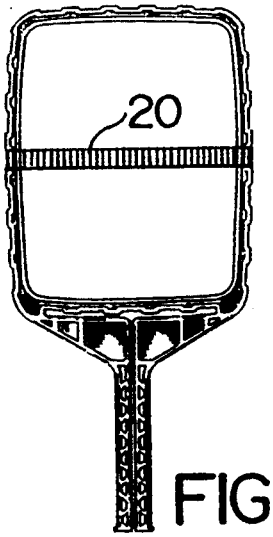
FIGS. 4A, 4B, 4C, 4D, 4E, 4F, and 4G show successive steps of stringing (installation) of five transversal and seven longitudinal flat rubber string loops.
Figure 4B:
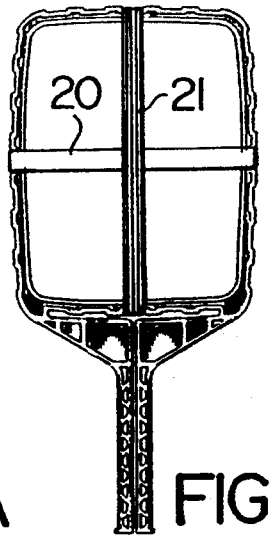
Figure 4C:
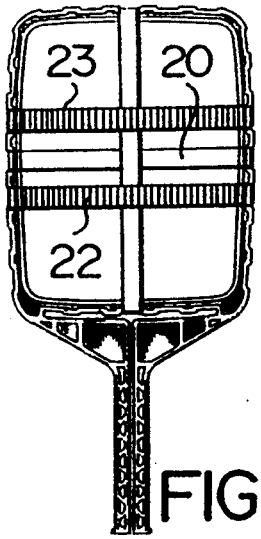
Figure 4D:
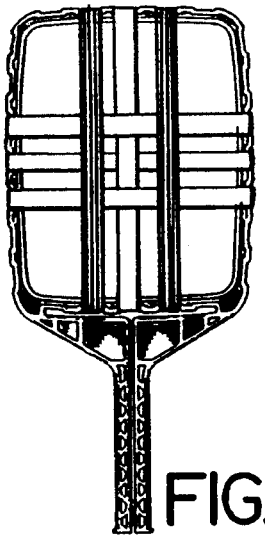
Figure 4E:
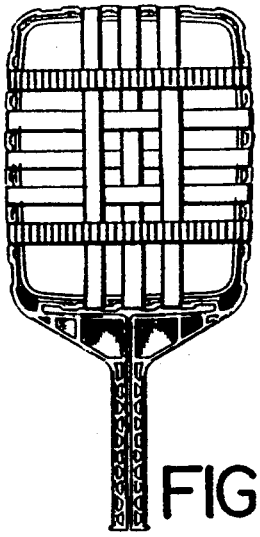
Figure 4F:
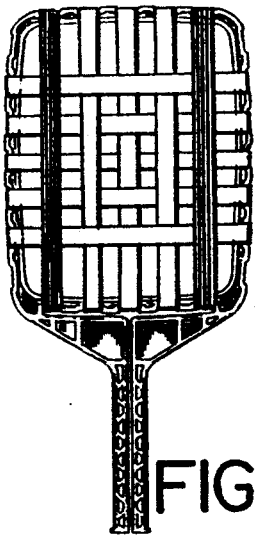
Figure 4G:
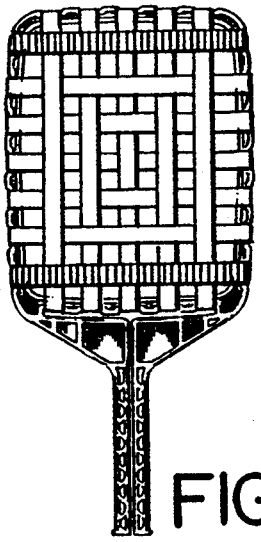

We now turn to FIGS. 4A to 4G showing the preferred mode of stringing, where in FIG. 4A a central transversal string 20 is first installed, followed by a central longitudinal string 21 in FIG. 4B. Then two transversal strings 22 and 23 are installed on either side of the string 20, are installed as shown in FIG. 4C, and so on as shown in FIGS. 4D, 4E, 4F until the entire twelve strings have been installed as shown in FIG. 4G.

The complete strung racket as shown in FIG. 4G is only missing the sleeve, or any arrangement to prevent the two shaft halves 13 and 14 from relative displacement, which would add to the comfort of the player. As may also be seen, the strings are flat extruded rubber bands for longer life. The width of the bands matches the recesses in the head frame 10. The sleeve would preferably be made from expanded polyurethane foam or other suitable conventional materials.

The embodiments of the invention in which an exclusive property or privilege are claimed are defined as follows:

1. A games racket having a strung head frame connected to a shaft with a distal end comprising: a longitudinal slit open from the distal end to the head frame dividing said shaft into halves;

a transversal slit along an edge of said head frame and communicating with said longitudinal slit;

and flat rubber band strings installed around the head frame through the longitudinal and transversal slits to provide a striking surface of said games racket.

2. The games racket as defined in claim 1, wherein the longitudinal slit in the shaft connects with the transversal slit to substantially form a "T".

3. The games racket as defined in claim 2, said head frame being substantially rectangular in shape, and tapering at one side thereon into said shaft.

4. The games racket as defined in claim 3, wherein the strings are strung between parallel sides of the head frame.

5. The games racket as defined in claim 4, wherein notches are located along edges of the head frame for receiving and aligning of the strings.

6. The games racket as defined in claim 5, wherein the shaft is adapted to receive a sleeve for comfort and ease of holding by a user.

7. The games racket as defined in claim 5, wherein the head frame and shaft are partially H- or I-beam shaped in cross section.

* * * * *